US006454013B1

(12) United States Patent
Metcalfe

(10) Patent No.: US 6,454,013 B1
(45) Date of Patent: Sep. 24, 2002

(54) EXPANDABLE DOWNHOLE TUBING

(75) Inventor: Paul David Metcalfe, Peterculter (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/530,301

(22) PCT Filed: Nov. 2, 1998

(86) PCT No.: PCT/GB98/03261

§ 371 (c)(1),
(2), (4) Date: Jun. 8, 2000

(87) PCT Pub. No.: WO99/23354

PCT Pub. Date: May 14, 1999

(30) Foreign Application Priority Data

Nov. 1, 1997 (GB) ..... 9723031

(51) Int. Cl.[7] ..... E21B 23/00
(52) U.S. Cl. ..... 166/382; 166/206; 166/207
(58) Field of Search ..... 166/206, 207, 166/277, 382

(56) References Cited

U.S. PATENT DOCUMENTS

| | | | | |
|---|---|---|---|---|
| 988,504 A | | 3/1911 | Wiet | |
| 1,233,888 A | * | 7/1917 | Leonard | 166/207 |
| 1,301,285 A | | 4/1919 | Leonard | |
| 1,880,218 A | | 10/1932 | Simmons | |
| 1,981,525 A | | 11/1934 | Price | 166/4 |
| 2,017,451 A | | 10/1935 | Wickersham | 166/10 |
| 2,214,226 A | | 9/1940 | English | 166/1 |
| 2,383,214 A | | 8/1945 | Prout et al. | 153/82 |
| 2,424,878 A | | 7/1947 | Crook | 154/82 |
| 2,499,630 A | | 3/1950 | Clark | 153/81 |
| 2,519,116 A | | 8/1950 | Crake | 166/10 |

(List continued on next page.)

FOREIGN PATENT DOCUMENTS

| | | | |
|---|---|---|---|
| DE | 3213464 A1 | 10/1983 | B23D/45/12 |
| DE | 4133802 C1 | 10/1992 | F16L/9/12 |
| EP | 0 952 305 A1 | 4/1998 | E21B/43/10 |
| GB | 730338 | 3/1954 | 84/4 |
| GB | 792886 | 4/1956 | |
| GB | 997721 | 7/1965 | |
| GB | 1277461 | 6/1972 | B21D/39/04 |
| GB | 1448304 | 9/1976 | E21B/33/13 |
| GB | 1457843 | 12/1976 | B21D/39/10 |
| GB | 1582392 | 1/1981 | B21D/39/10 |
| GB | 2216926 A | 10/1989 | E21B/7/20 |
| GB | 2 313 860 B | 6/1996 | E21B/10/34 |
| GB | 2329918 A | 4/1999 | E21B/43/10 |
| WO | WO 92/01139 | 1/1992 | E21B/17/08 |
| WO | WO 93/24728 | 12/1993 | E21B/17/10 |
| WO | WO 93/25800 | 12/1993 | E21B/43/10 |
| WO | WO 94/25655 | 11/1994 | D04C/1/06 |
| WO | WO 97/21901 | 6/1997 | E21B/17/08 |
| WO | WO 98/00626 | 1/1998 | E21B/43/10 |
| WO | WO 99/02818 | 1/1999 | E21B/43/10 |
| WO | WO 99/18328 | 4/1999 | E21B/23/01 |
| WO | WO 99/23354 | 5/1999 | E21B/43/10 |

OTHER PUBLICATIONS

Metcalfe, P.—"Expandable Slotted Tubes Offer Well Design Benefits", *Petroleum Engineer International*, vol. 69, No. 10 (Oct. 1996), pp. 60–63—XP000684479.

*Primary Examiner*—Hoang Dang
(74) *Attorney, Agent, or Firm*—Moser, Patterson & Sheridan, L.L.P.

(57) ABSTRACT

A tubing coupling method comprises the steps: providing a length of expandable tubing (72) and a length of larger diameter non-expanding tubing (74); connecting an end portion of the expandable tubing (72) to an end portion of the non-expanding tubing (74) with a portion of expandable tubing (76); running the tubing (72, 74, 76) into a bore; and expanding the expandable tubing (72, 76). The expandable tubing (72) may form part of an expandable well or sand screen, or may be expandable bore liner (12).

14 Claims, 3 Drawing Sheets

U.S. PATENT DOCUMENTS 2,627,891 A 2/1953 Clark ..... 153/82
2,633,374 A 3/1953 Boice ..... 285/118
3,028,915 A 4/1962 Jennings ..... 166/16
3,039,530 A 6/1962 Condra ..... 166/55
3,167,122 A 1/1965 Lang ..... 166/14
3,179,168 A 4/1965 Vincent ..... 166/14
3,186,584 A 6/1965 Owen ..... 166/63
3,191,677 A 6/1965 Kinley ..... 166/14
3,191,680 A 6/1965 Vincent ..... 166/46
3,203,451 A 8/1965 Vincent ..... 138/143
3,203,483 A 8/1965 Vincent ..... 166/207
3,245,471 A 4/1966 Howard ..... 166/46
3,297,092 A 1/1967 Jennings ..... 166/207
3,326,293 A 6/1967 Skipper ..... 166/150
3,353,599 A 11/1967 Swift ..... 166/15
3,354,955 A 11/1967 Berry ..... 166/14
3,477,506 A 11/1969 Malone ..... 166/207
3,489,220 A 1/1970 Kinley ..... 166/277
3,583,200 A 6/1971 Cvijanovic et al. ..... 72/393
3,669,190 A 6/1972 Sizer et al. ..... 166/315
3,689,113 A 9/1972 Blaschke ..... 285/90
3,691,624 A 9/1972 Kinley ..... 29/523
3,712,376 A 1/1973 Owen et al. ..... 166/277
3,746,091 A 7/1973 Owen et al. ..... 166/207
3,776,307 A 12/1973 Young ..... 166/125
3,780,562 A 12/1973 Kinley ..... 72/479
3,785,193 A 1/1974 Kinley et al. ..... 72/393
3,820,370 A 6/1974 Duffy ..... 72/75
3,948,321 A 4/1976 Owen et al. ..... 166/277
3,977,076 A 8/1976 Vieira et al. ..... 30/103
4,319,393 A 3/1982 Pogonowski ..... 29/434
4,349,050 A 9/1982 Bergstrom et al. ..... 138/147
4,359,889 A 11/1982 Kelly ..... 72/62
4,362,324 A 12/1982 Kelly ..... 285/119
4,382,379 A 5/1983 Kelly ..... 73/46
4,387,502 A 6/1983 Dom ..... 29/568
4,407,150 A 10/1983 Kelly ..... 72/61
4,414,739 A 11/1983 Kelly ..... 29/727
4,445,201 A 4/1984 Pricer ..... 365/154
4,450,612 A 5/1984 Kelly ..... 72/62
4,470,280 A 9/1984 Kelly ..... 72/61
4,483,399 A 11/1984 Colgate ..... 166/308
4,487,630 A 12/1984 Crook et al. ..... 75/123 B
4,502,308 A 3/1985 Kelly ..... 72/58
4,505,142 A 3/1985 Kelly ..... 72/54
4,505,612 A 3/1985 Shelley, Jr. ..... 405/101
4,567,631 A 2/1986 Kelly ..... 29/157.3
4,581,617 A 4/1986 Yoshimoto et al. ..... 346/108
4,626,129 A 12/1986 Kothmann et al. ..... 405/43
4,807,704 A 2/1989 Hsu et al. ..... 166/313
4,866,966 A 9/1989 Hagan ..... 72/75
4,883,121 A 11/1989 Zwart ..... 166/217
4,976,322 A 12/1990 Abdrakhmanov et al. .... 175/57
4,997,320 A 3/1991 Hwang ..... 408/22
5,014,779 A 5/1991 Meling et al. ..... 166/55.7
5,031,699 A * 7/1991 Artynov et al. ..... 166/285
5,052,483 A 10/1991 Hudson ..... 166/55
5,052,849 A 10/1991 Zwart ..... 403/300
5,156,209 A 10/1992 McHardy ..... 166/324
5,267,613 A 12/1993 Zwart et al. ..... 166/178
5,271,472 A 12/1993 Leturno ..... 175/107
5,301,760 A 4/1994 Graham ..... 175/61
5,307,879 A 5/1994 Kent ..... 166/382
5,322,127 A 6/1994 McNair et al. ..... 166/313
5,348,095 A 9/1994 Worrall et al. ..... 166/380
5,366,012 A 11/1994 Lohbeck ..... 166/277
5,409,059 A 4/1995 McHardy ..... 166/208
5,472,057 A 12/1995 Winfree ..... 175/57
5,520,255 A 5/1996 Barr et al. ..... 175/24
5,553,679 A 9/1996 Thorp ..... 175/73
5,560,426 A 10/1996 Trahan et al. ..... 166/120
5,636,661 A 6/1997 Moyes ..... 137/614.2
5,667,011 A 9/1997 Gill et al. ..... 166/295
5,706,905 A 1/1998 Barr ..... 175/61
5,785,120 A 7/1998 Smalley et al. ..... 166/55
5,887,668 A 3/1999 Haugen et al. ..... 175/79
5,901,789 A 5/1999 Donnelly et al. ..... 166/381
5,924,745 A 7/1999 Campbell ..... 285/90
5,960,895 A 10/1999 Chevallier et al. ..... 175/27
5,979,571 A 11/1999 Scott et al. ..... 175/61
5,984,568 A * 11/1999 Lohbeck ..... 403/375
6,012,522 A * 1/2000 Donnelly et al. ..... 166/276
6,012,523 A * 1/2000 Campbell et al. ..... 166/277
6,029,748 A 2/2000 Forsyth et al. ..... 166/380
6,050,341 A * 4/2000 Metcalf ..... 166/383
6,070,671 A 6/2000 Cumming et al. ..... 166/381
6,085,838 A * 7/2000 Vercaemer et al. ..... 166/277
6,112,818 A * 9/2000 Campbell ..... 166/384
6,273,634 B1 * 8/2001 Lohbeck ..... 403/297

* cited by examiner

EXPANDABLE DOWNHOLE TUBING

This invention relates to expandable downhole tubing. In particular, the invention relates to coupling or connecting expandable downhole tubing. One aspect of the invention relates to a method of locating a section of expandable tubing in a bore.

Expandable tubing for use in downhole applications is described in WO93/25800, the disclosure of which is incorporated herein by reference. The tubing is useful as, for example, borehole liner or as a sandscreen support, the use of expandable tubing in sandscreens being more fully described in WO97/17524, the disclosure of which is also incorporated herein by reference. In one application, a section of expandable tubing is positioned in an unlined section of bore intersecting a hydrocarbon-bearing is formation, below an existing bore casing and bore liner. The tubing is then expanded, preferably into contact with the bore wall. The expanded liner supports the bore wall while allowing oil and gas to pass from the formation into the bore. In another application, an expandable well screen is provided, the screen comprising perforated filter sheets mounted on an expandable slotted carrier tube and within a coaxial expandable slotted protective tube. The well screen is expanded downhole to such a size that the protective tube can be set against the surrounding formation.

For locating expandable tubing in a bore it would be preferable to provide a secure connection between the upper end of the expandable tubing and the lower end of an existing bore liner; simply locating the tubing in the liner, with no mechanical connection therebetween, may result in an offset between the two, creating an irregularity on which tools may snag and an unwanted gap through which fluid may flow.

U.S. Pat. No. 3,353,599 discloses a method for securing ends of expandable liner to solid surrounding tubing by means of plastic impregnated glass filter mats. However, the applicant considers that this method would encounter many difficulties in this particular application due to, for example, contamination of the mats by the fluid in the bore and the possibility of the mats being dislodged or damaged during installation of the liner and the expandable tubing, or during other downhole operations.

It is among the objectives of the present invention to obviate or mitigate these disadvantages.

According to the present invention there is provided a method of coupling a section of expandable tubing, the method comprising the steps:

providing a length of expandable tubing and a length of larger diameter non-expanding tubing;

connecting an end portion of said expandable tubing to an end portion of said non-expanding tubing with a portion of expandable tubing;

running the tubing into a bore; and expanding the expandable tubing.

According to a further aspect of the present invention there is provided a tubing assembly comprising a length of expandable tubing, a length of larger diameter nonexpanding tubing, and a connecting portion of expandable tubing connecting an end portion of the expandable tubing to an end portion of the non-expanding tubing.

These aspects of the invention facilitate connection of a length of expandable tubing to a length of nonexpanding tubing.

The expandable tubing may be a borehole liner or support, or may form part of an expandable well screen or sand screen.

The non-expanding tubing may be a solid connector or coupling, and thus may be a solid connector for joining two lengths of expandable tubing. In particular, this embodiment of the invention permits expandable well screen or sand screen sections to be connected using solid connectors, obviating the difficulties involved in connecting such well screen sections utilising expandable connectors.

The connecting portion may be formed by partially expanding an end of the expandable tubing to a diameter corresponding to the non-expanding tubing. Alternatively, the non-expanding tubing may have an expandable tapering end portion which forms the connecting portion, the smaller diameter end of the tapering portion being of a diameter corresponding to the expandable tubing.

The connecting portion may be welded to one or both of the expandable tubing and the non-expanding tubing. Alternatively, the connection may be provided by other means, such as screw threads, pins, screws, rivets or radially movable keys or fingers engaging corresponding profiles.

According to another aspect of the present invention there is provided a method of locating a section of expandable tubing in a bore, the method comprising the steps:

providing a length of expandable tubing and a length of larger diameter non-expanding tubing;

connecting an end portion of said expandable tubing to an end portion of said non-expanding tubing with a portion of expandable tubing;

running the connected tubing into a bore;

fixing said non-expanding tubing in the bore; and expanding the expandable tubing.

According to a still further aspect of the present invention there is provided a tubing assembly comprising a length of expandable tubing, a length of larger diameter non-expanding tubing including means for connecting the non-expanding tubing to further tubing located in a bore, and a connecting portion of expandable tubing connecting an end portion of the expandable tubing to an end portion of the non-expanding tubing, the arrangement being such that, in use, the connected tubing may be run into a bore as a unit.

Thus, in these aspects of the present invention, the expandable tubing is connected to the non-expanding tubing on surface, prior to running the expandable tubing into the bore and prior to expansion of the tubing. The non-expanding tubing may be fixed in the bore by any suitable connecting means, typically by connection to an existing section of bore liner or casing. The connection may utilise, for example, a liner hanger, a packer, cooperating screw threads or radially movable keys engaging corresponding profiles.

The expandable tubing may be a borehole liner or support, or may form part of an expandable well screen or sand screen.

The connecting portion may be formed by expanding an upper end of the expandable tubing to a diameter corresponding to the non-expanding tubing. Alternatively, the non-expanding tubing may have an expandable tapering lower end portion which forms the connecting portion, the smaller diameter end of the tapering portion being of a diameter corresponding to the expandable tubing.

Preferably also, the assembly includes a running tool including means for releasably mounting the tubing thereon. The mounting means may be released utilising one of, or a combination of, mechanical force and fluid pressure. Preferably also, the running tool incorporates means for expanding the expandable tubing, which means may be a cone or mandrel which will expand the tubing when pushed or pulled therethrough. Most preferably, the expanding means is initially located within the connecting portion.

The connecting portion may be welded to one or both of the expandable tubing and the non-expanding tubing. Alternatively, the connection may be provided by other means, such as screw threads, pins, screws, rivets or radially movable keys or fingers engaging corresponding profiles.

These and other aspects of the present invention will now be described, by way of example, with reference to the accompanying drawings, in which.

Figure 1:
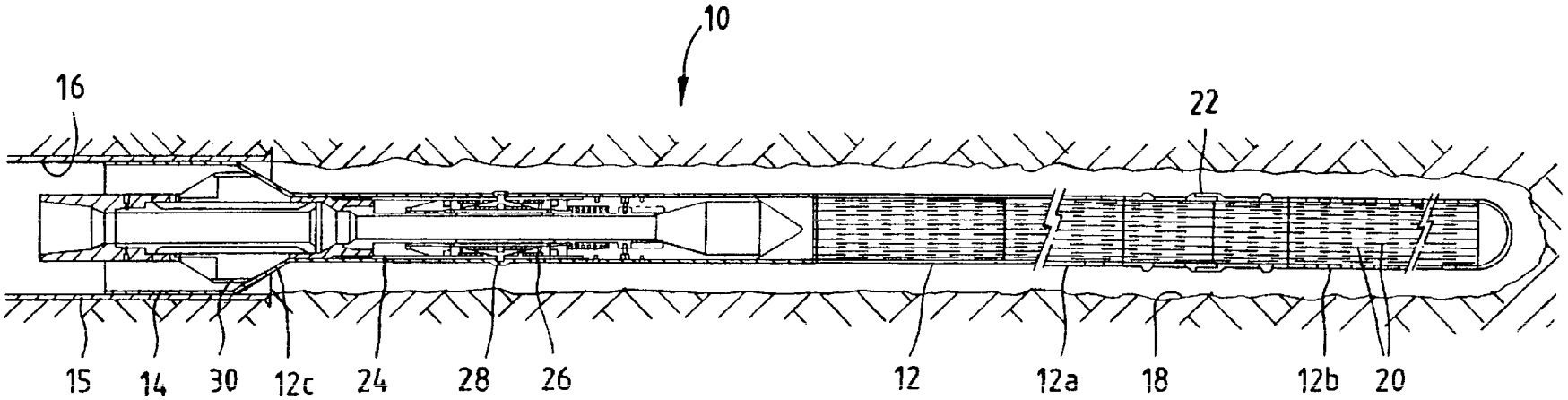
FIG. 1 is a sectional view of a tubing assembly in accordance with an embodiment of the present invention, shown located in the sump end of a bore.

The assembly 10 comprises expandable tubing 12 connected to the lower end of a non-expanding sleeve 14, the sleeve 14 being fixed relative to a section of bore casing 15 which defines a seal bore 16. The expandable tubing 12 is initially of a smaller diameter than the sleeve 14 and casing 15 and extends into the uncased lower end of a drilled bore 18, this being the section of the bore 18 which intersects the oil-bearing formation. The expandable tubing 12 is similar to that described in WO93/25800, the tubing wall defining a multiplicity of overlapping longitudinal slots 20. A number of tubing sections 12*a*, 12*b* are provided and are joined together using appropriate connectors 22, such as the connectors described in PCT\GB96\01250 or PCT\GB96\03026, the disclosures of which are incorporated herein by reference.

Figure 2:
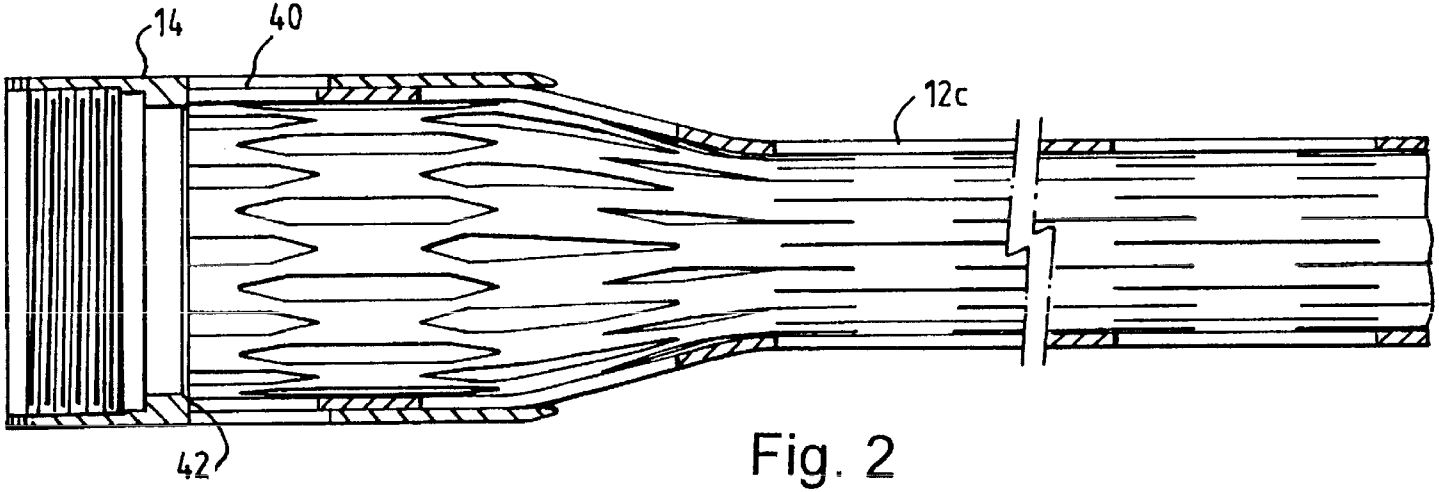
FIG. 2 is an enlarged sectional view of a portion of the tubing assembly of FIG. 1.

At its upper end 12*c*, the tubing 12 has been preexpanded to a diameter corresponding to the diameter of the sleeve 14, and the pre-expanded portion 12*c* welded to the sleeve 14, as illustrated in greater detail in FIG. 2. The lower end portion of the sleeve 14 receives the upper pre-expanded end 12*c* of the tubing and is slotted 40, to facilitate welding of the tubing 12*c* to the sleeve 14. Further, the sleeve 14 defines a shoulder 42 for abutting the upper end of the expanded tubing end 12*c*. In use, the sleeve 14 is threaded and pinned to a liner section including a conventional hanger (not shown) for connection to the existing bore casing 15.

Located within the pre-expanded portion 12*c* is a running tool 24 for connection to the lower end of a running string (not shown), typically formed of drill pipe. The running tool 24 features radially movable keys 26 which releasably engage a profile 28 on the expandable tubing 12.

The illustrated running tool is similar to the tool described in our earlier UK patent application GB 9625937.9, the disclosure of which is incorporated herein by reference, and may be activated by fluid pressure to retract the keys 26 and release the tubing assembly 12, 14 when desired. The upper end of the running tool 24 includes an expansion cone 30 which may be pushed downwardly to expand the tubing 12, as will be described below.

In use, the expandable tubing 12 and the sleeve 14 are welded together on the surface and the running tool 24 located within the tubing assembly 12, 14 with the keys 26 extended to engage the tubing profile 28. The running tool 24 is then mounted on the lower end of the running string and the assembly of the tubing 12, sleeve 14, liner, liner hanger and tool 24 run into the bore 18.

On reaching the lower end of the bore 18, the liner hanger is actuated to fix the liner to the lower end of the bore casing, above the uncased section of bore. The running tool 24 is then manipulated and fluid pressure applied to the tool 24 from the surface through the running string to retract the keys 26 and release the tubing 12 and liner. The running tool 24 is then pushed downwardly, through the tubing 12, such that the cone 30 expands the tubing 12 into contact with the bore wall, the solid non-expanding sleeve 14 preventing the pre-expanded tubing end 12*c* from bellowing out during expansion of the remainder of the tubing 12. The running tool 24 is then withdrawn. Thus, the invention obviates the need to form a connection between the expandable tubing 12 and the non-expanding liner while the tubing 12 and liner are downhole.

Figure 3:
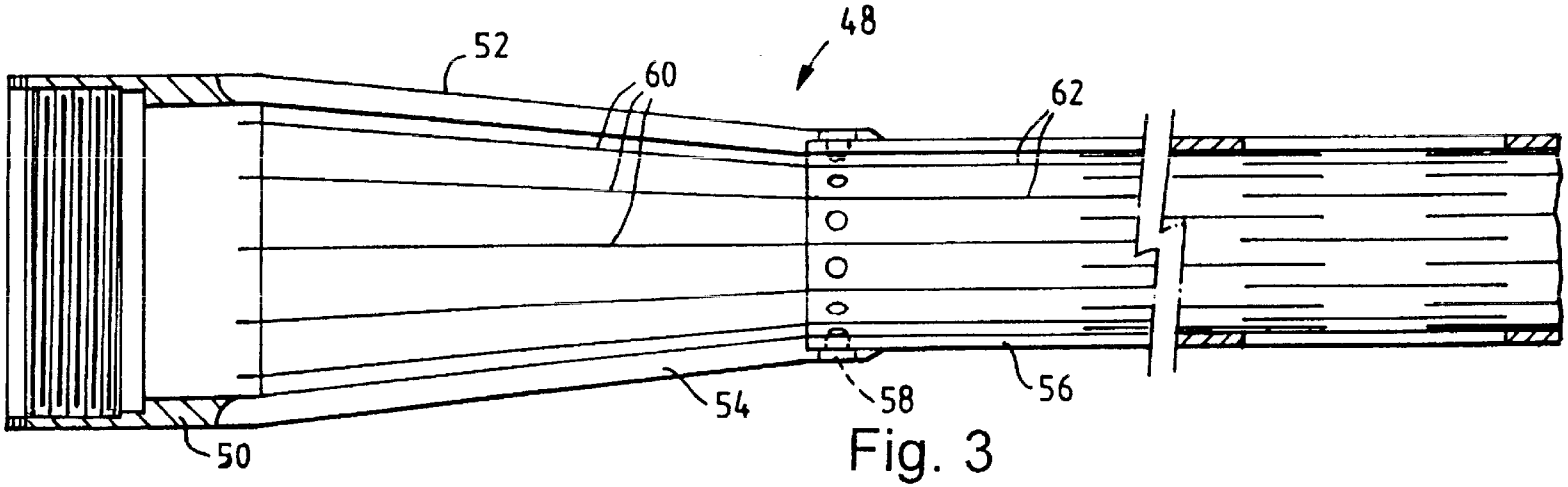
FIG. 3 is a sectional view of a portion of a tubing assembly in accordance with a further embodiment of the present invention.

Reference is now made to FIG. 3 of the drawings, which is a sectional view of a portion of a tubing assembly 48 in accordance with a further embodiment of the present invention. In this embodiment a lower liner section 50 defines a tapering connecting portion 52 formed of a plurality of connecting arms 54. The upper end of the expandable tubing 56 is fixed to the arms 54 by appropriate screws 58, and it will be noted that the slots 60 in the connecting portion 52 correspond with the slots 62 in the expandable tubing 56.

This assembly 48 is utilised in a similar manner to the assembly 10 described above, however the expansion cone 30 will expand the tapering connection portion 52 as well as the expandable tubing 56.

Figure 4:
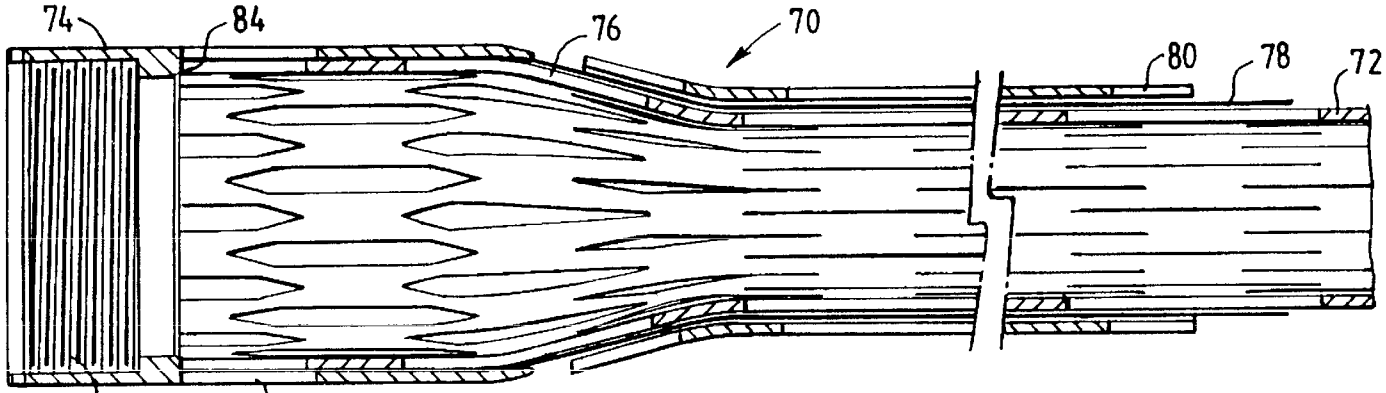
FIG. 4 is a sectional view of a portion of a tubing assembly in accordance with another embodiment of the present invention.

Reference is now made to FIG. 4 of the drawings, which illustrates a tubing assembly 70 comprising a length of expandable tubing, in the form of an expandable slotted carrier tube 72, a length of larger diameter non-expanding tubing, in the form of a solid connector 74, and a connecting portion of expandable tubing 76 connecting the end portion of the carrier tube 72 to the end portion of the connector 74.

The carrier tube 72 supports perforated filter sheets 78 and an expandable slotted protective tube 80 is mounted over the sheets 78, thus forming an expandable sand screen assembly, such as described in WO97/17524.

At its upper end, the carrier tube 72 has been pre-expanded to a diameter corresponding to the diameter of the connector 74, and the pre-expanded connecting portion 76 welded to the connector 74. The lower end portion of the connector 74 receives the connecting portion 76 and is slotted 82, to facilitate welding of the tubing portion 76 to the connector 74. Further, the connector 74 defines a shoulder 84 for abutting the upper end of the expanded tubing end 76, and an internal thread 86.

The perforated filter sheets 78 extend to adjacent the end of the carrier tube 72 and thus extend into the connector 74. The outer protective tube 80 stops short of the end of the carrier tube 72 and does not extend into the connector 74. The pre-expansion of the carrier tube 72 produces a corresponding expansion of the filter sheets 78 and an expansion of the end of the tube 80.

In use, the connector 74 is threaded and pinned to a corresponding solid connector (not shown) defining an external thread coupled to the lower end of another expandable sand screen section. A number of sand screen sections may be coupled in this manner and run downhole to a desired location in the bore. An expansion cone or the like is then pushed or pulled through the sand screen sections and causes the unexpanded and partially expanded sections of sand screen to expand to a diameter corresponding to the diameter of the connectors 74, which will correspond closely to the bore diameter. Further, as described in WO93/25800, by selecting an appropriate cone profile it is possible to expand the tubing to a diameter greater than that of the cone, and in this manner it may be possible to expand the sand screen assembly such that the outer tubing 80 is expanded into contact with the bore wall. This effect may also be achieved or facilitated by selecting the relative dimensions of the connector 74 and sand screen elements such that on expanding the inner tubing 72 to a diameter corresponding to the inner diameter of the connector 74, the outer surface of the expanded tubing 80 extends radially beyond the outer surface of the connector.

Figure 5:
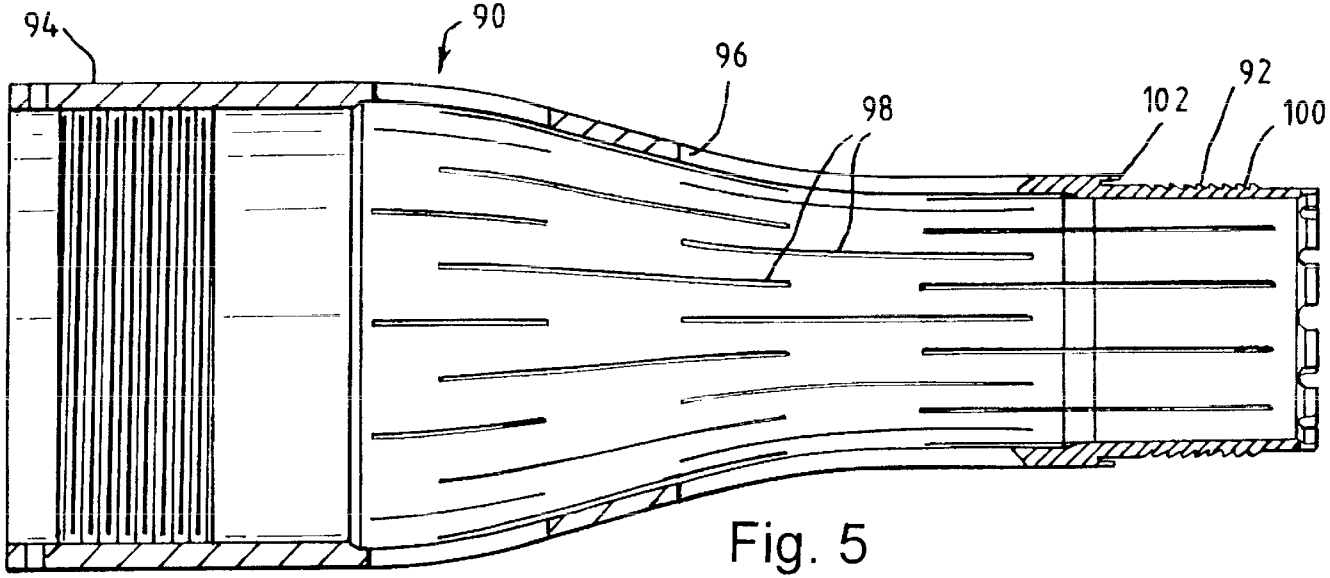
FIG. 5 is a sectional view of a portion of a tubing assembly in accordance with a still further embodiment of the present invention.

Reference is now made to FIG. 5 of the drawings, which illustrates a tubing assembly 90 in accordance with a still further aspect of the present invention. The assembly 90 comprises an expandable pin connector 92, for coupling to a section of expandable bore liner or an expandable screen, a solid crossover section 94 for coupling to a hanger, and a tapering connecting portion 96 machined in a similar manner to a section of expandable tubing, that is the portion 96 defines a number of overlapping longitudinal slots 98.

The pin connector 92 defines an external thread 100, and an undercut 102 for engaging corresponding features on a connector provided on the expandable bore liner or screen; the expandable connector is generally similar in form to the connector described in our PCT\GB96\01250, the disclosure of which is incorporated herein by reference.

It will be clear to those of skill in the art that the above described embodiments are merely exemplary of the present invention and that various modifications and improvements may be made thereto without departing from the scope of the invention. For example, the assembly 10 may be provided in conjunction with another form of running tool, or may be utilised to locate expandable tubing in other locations in a bore and to connect expandable tubing to other forms of solid tubing. Further, the connector 74 may be utilised to connect other forms of sand screen incorporating different filter media, or may be utilised to connect single lengths of expandable tubing.

What is claimed is:

1. A method for expanding tubulars, comprising:

providing a length of expandable tubing and a length of larger diameter tubing;

connecting an end portion of the expandable tubing to an end portion of the larger diameter tubing, wherein the connection is formed by partially expanding the end portion of the expandable tubing to a diameter corresponding to the larger diameter tubing;

running the connected tubing into a bore; and expanding the expandable tubing.

2. The method of claim 1, wherein the expandable tubing is expanded to provide a borehole liner or support.

3. The method of claim 1, wherein the expandable tubing is expanded to provide at least part of an expandable well screen or sand screen.

4. The method of claim 1, wherein the larger diameter tubing is a solid connector and is joined to a second length of expandable tubing.

5. The method of claim 1, wherein the connection is formed by providing the larger diameter tubing with an expandable tapering end portion.

6. The method of claim 1, wherein the larger diameter tubing is or forms part of a connector.

7. The assembly of claim 6, wherein the connector is adapted for joining two lengths of expandable tubing.

8. The assembly of claim 7, wherein the connector is adapted for joining lengths of expandable tubing forming part of respective expandable well screen or sand screen sections.

9. The method of claim 1, further comprising fixing the larger diameter tubing in the bore by connection to an existing section of bore liner or casing.

10. The method of claim 1, wherein the larger diameter tubing is fixed in the bore by a liner hanger.

11. A method for expanding tubulars, comprising:

providing an expandable tubing and a larger diameter tubing, wherein the larger diameter tubing has an expandable, tapering end portion;

connecting an end portion of the expandable tubing to the expandable tapering end portion of the larger diameter tubing;

running the connected tubing into a bore; and expanding the expandable tubing.

12. The method of claim 11, wherein the expandable tubing is expanded to provide a borehole liner or support.

13. The method of claim 11, wherein the expandable tubing is expanded to provide at least part of an expandable well screen or sand screen.

14. The method of claim 11, wherein the connection is welded to one or both of the expandable tubing and the larger diameter tubing.

* * * * *